US007471210B2

(12) United States Patent
Cole, Sr. et al.

(10) Patent No.: US 7,471,210 B2
(45) Date of Patent: Dec. 30, 2008

(54) POINT OF SALE DISPLAY FOR DOORBELL

(75) Inventors: Phillip R. Cole, Sr., South Bend, IN (US); Jimmy Kendrick, Milner, GA (US); Daniel John Beasley, Broomsgrove (GB); Lai Kong Yeow, South Bend, IN (US)

(73) Assignee: IQ Group Sdn Bhd, Penang (MY)

( * ) Notice: Subject to any disclaimer, the term of this patent is extended or adjusted under 35 U.S.C. 154(b) by 253 days.

(21) Appl. No.: 11/512,965

(22) Filed: Aug. 30, 2006

(65) Prior Publication Data

US 2006/0290477 A1 Dec. 28, 2006

Related U.S. Application Data

(62) Division of application No. 10/798,836, filed on Mar. 11, 2004, now Pat. No. 7,126,490.

(60) Provisional application No. 60/503,626, filed on Sep. 17, 2003.

(51) Int. Cl.
*G08B 3/001* (2006.01)

(52) U.S. Cl. ..... 340/691.6; 340/384.1; 340/531

(58) Field of Classification Search ..... 340/691.6, 340/384.1, 392.1, 328, 326, 692, 691.1, 330, 340/393.3, 396.1, 392.4, 573.1, 531; 705/10, 705/27, 16, 26; 434/365, 369, 379, 382, 434/401

See application file for complete search history.

(56) References Cited

U.S. PATENT DOCUMENTS

| | | | | | |
|---|---|---|---|---|---|
| 4,142,216 | A | | 2/1979 | Goss et al. | 360/72.1 |
| 4,976,214 | A | * | 12/1990 | Taylor | 116/100 |
| 5,159,328 | A | | 10/1992 | Albrecht | 340/815.47 |
| 5,243,504 | A | * | 9/1993 | Sejzer | 362/154 |
| 5,659,286 | A | | 8/1997 | Lin | 340/328 |
| 5,774,041 | A | * | 6/1998 | Xydis et al. | 340/396.1 |
| 5,883,570 | A | * | 3/1999 | Lusareta et al. | 340/384.7 |
| 6,414,589 | B1 | * | 7/2002 | Angott et al. | 340/326 |
| 6,658,771 | B1 | | 12/2003 | Forrest et al. | 340/312 |
| 6,750,760 | B2 | * | 6/2004 | Albritton et al. | 340/392.1 |
| 2003/0090369 | A1 | | 5/2003 | Albritton et al. | |

* cited by examiner

*Primary Examiner*—Daniel Previl
(74) *Attorney, Agent, or Firm*—Botkin & Hall, LLP

(57) ABSTRACT

A doorbell having interchangeable chimes and interchangeable decorative covers is displayed for sale to the retail public such that a customer may easily choose a specific chime sound and combine it with a specific decorative cover enabling the customer to buy a doorbell meeting the customer's aesthetic requirement. The interchangeable bases and covers may include complimentary attachment parts that allow any cover to be mounted to any of a plurality of bases of differing size and in different orientations.

4 Claims, 11 Drawing Sheets

POINT OF SALE DISPLAY FOR DOORBELL

CROSS REFERENCE TO RELATED APPLICATIONS

This application is a divisional of U.S. patent application Ser. No. 10/798,836, filed Mar. 11, 2004, now U.S. Pat. No. 7,126,490 which claims priority to U.S. provisional application for patent Ser. No. 60/503,626, filed Sep. 17, 2003.

BACKGROUND OF THE INVENTION

1. Field of the Invention

The invention relates to a point of sale display which will have specific but not limited application to the sale of doorbells.

2. Discussion of Background Art

A doorbell can be an expression of its owner's personality. Therefore, in order to satisfy a broad range of users, doorbells often come in different styles, including different chimes and different appearances. It has been common in the industry to manufacture different doorbells and sell them as complete sets, including a particular chime combined with a particular decorative cover for the chime. Because the doorbells are marketed as a single unit, however, a retailer is required to maintain a large stock of many different doorbells, covering a wide spectrum of combinations of chimes and decorative covers. This can be onerous to the retailer's overhead costs. It can also be confusing to a customer who must consider a large number of completed combinations before settling on the final doorbell with a specific chime and a specific decorative cover. Therefore, it would be advantageous to be able to present to a customer a variety of doorbell chimes and separate decorative covers that may be individually selected and then easily assembled by the customer.

SUMMARY OF THE INVENTION

A doorbell or similar item may be assembled from subcomponents such as by selecting a chime base from a plurality of different chime bases and combining it with a decorative cover plate selected from a plurality of different decorative cover plates.

The method of this invention of presenting the doorbells to a consumer includes providing a point of purchase display board near a parts bin in an area accessible to the consuming public. The display board displays different examples of the various combinable doorbell subcomponents from which the customer may choose. A supply of each subcomponent is stored in its own compartment in the storage bin. Identifiers associated with each subcomponent on the display board are placed near the displayed subcomponent and also on the corresponding compartment in the parts bin. The customer can retrieve the chosen subcomponent from the parts bin by matching the identifier on the display board with the identifier on the parts bin compartment, and retrieve the appropriate subcomponent from the compartment.

A doorbell chime assembly that may be used in the method of this invention includes a base portion and a cover portion. Both the base portion and the cover portion may be interchanged with a plurality of other base and cover portions so that any one particular base portion may be combined with any one particular cover portion. Both the base portion and the cover portion carry attachment parts that allow the cover portion to be mounted to the base portion in a plurality of orientations. The attachment parts are adapted so that the cover may be mounted to a plurality of bases having different thicknesses.

An object of the invention is to provide a new method of presenting various combinable subcomponents to a consumer in a manner allowing the consumer to choose an item from several possible combinations that pleases that consumer's unique aesthetic predilections. Another object of the invention is to provide a line of doorbell parts including various chime bases and decorative covers that may be easily interchanged to allow a purchaser to mix and match bases with decorative covers.

BRIEF DESCRIPTION OF THE DRAWINGS

These and other aspects of the invention will be apparent from the following description, with reference to the accompanying drawings, in which.

DETAILED DESCRIPTION

Figure 1:
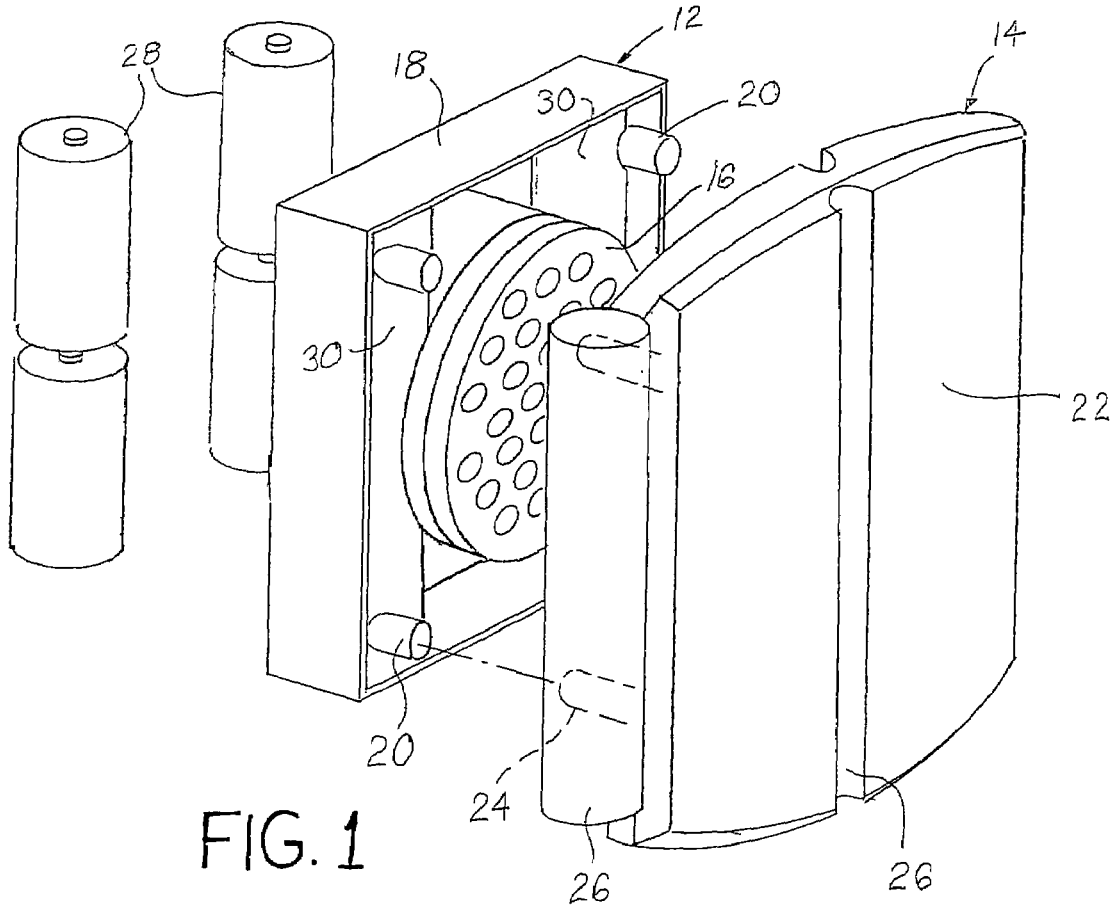
FIG. 1 is an exploded view of a doorbell having a chime and a removable cover.

Referring now to the drawings, a doorbell 10 includes a chime base 12 and a removable decorative cover 14. Chime base 12 includes an audio chime 16 carried by a housing 18 and mounting pins 20 carried by the housing 18. Decorative cover 14 includes a faceplate 22 and rear mounting sockets 24 carried by the faceplate. Housing 18 and decorative cover 14 are preferably made of molded plastic. Chime 16 may be an electronic sound generator or an electromechanical sound generator. Faceplate 22 includes decorative features 26 molded on its exterior face. Mounting sockets 24 correspond in placement and number with mounting pins 20 on housing 18. Aligned mounting sockets 24 and mounting pins 20 have a complementary resilient frictional interference fit or snap fit with each other. Decorative cover 14 is removably mounted to chime base 12 by press fitting mounting sockets 24 on faceplate 22 over pins 20 on housing 18. The frictional interference fit between mounting pins 20 and mounting sockets 24 prevents decorative cover 14 from disengaging from chime base 12. Decorative cover 14 may be removed from chime base 12 by overcoming the resilient frictional interference fit between the plugs and the sockets.

Chime 16 requires an electrical power source to activate the chime. As shown in FIG. 1, a set of electrochemical batteries 28 are fitted into holding ports 30 in housing 18. This particular arrangement would be used for a wireless doorbell activated by a radio frequency signal. The chime base could also be hard wired to the electrical system of a building with appropriate wiring. Chime base 12 may then be hung on a wall or other surface using appropriate mounting hardware.

Figure 2:
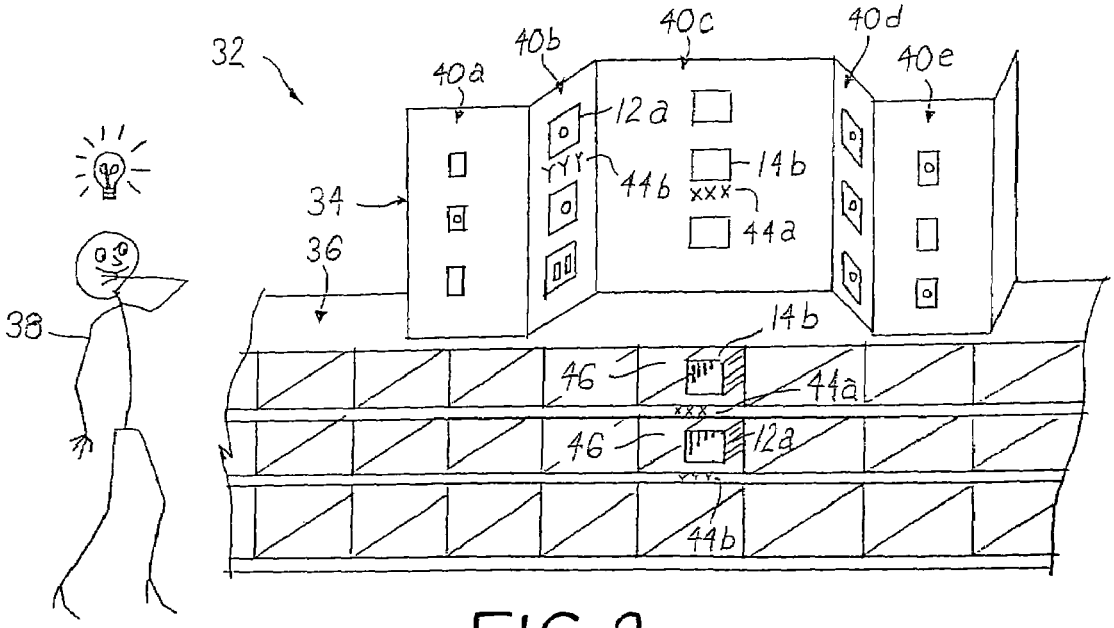
FIG. 2 depicts a display arrangement for selling the doorbell of FIG. 1.
Figure 3:
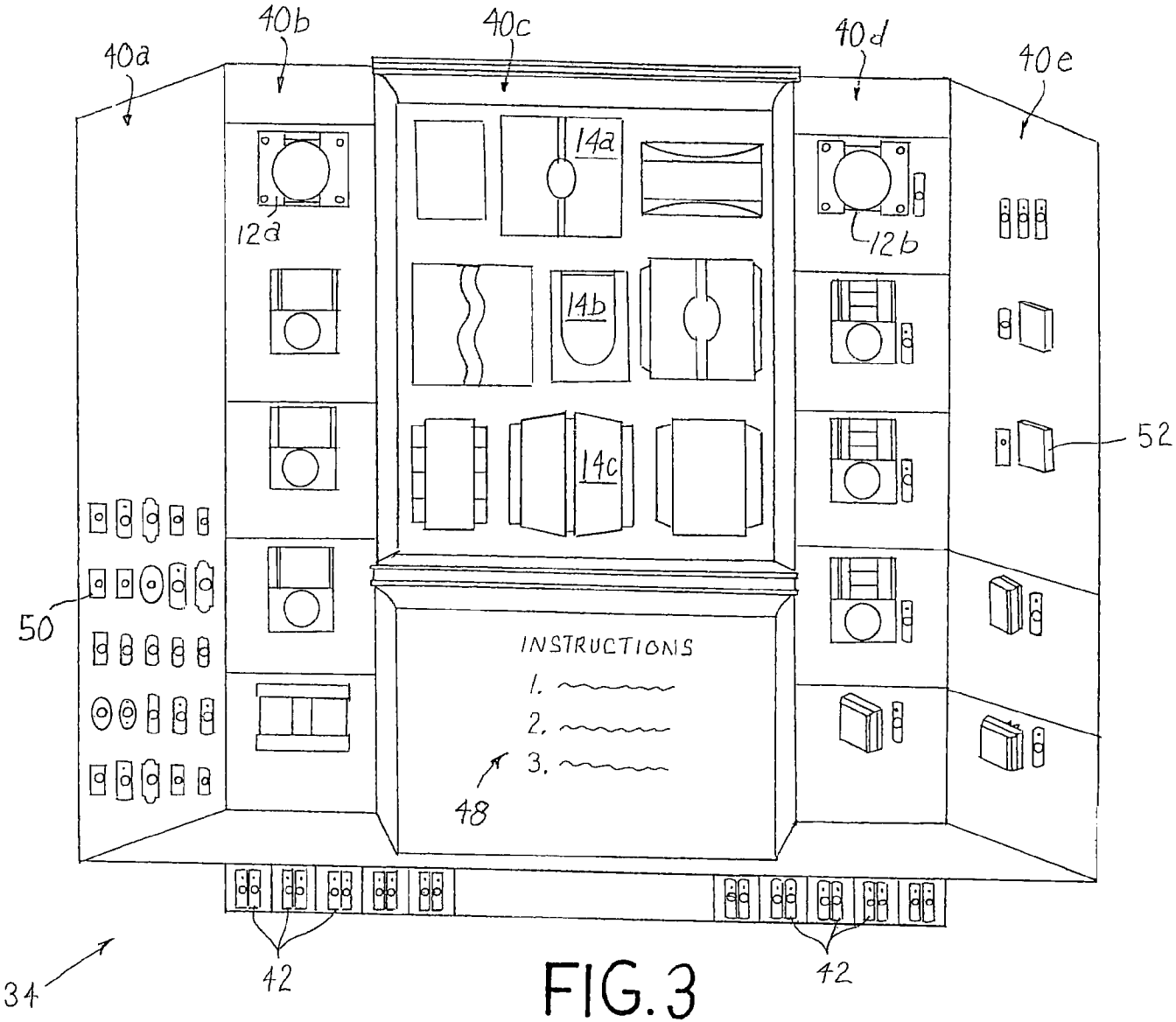
FIG. 3 depicts a display board for use in the display of FIG. 2.
Figure 4:
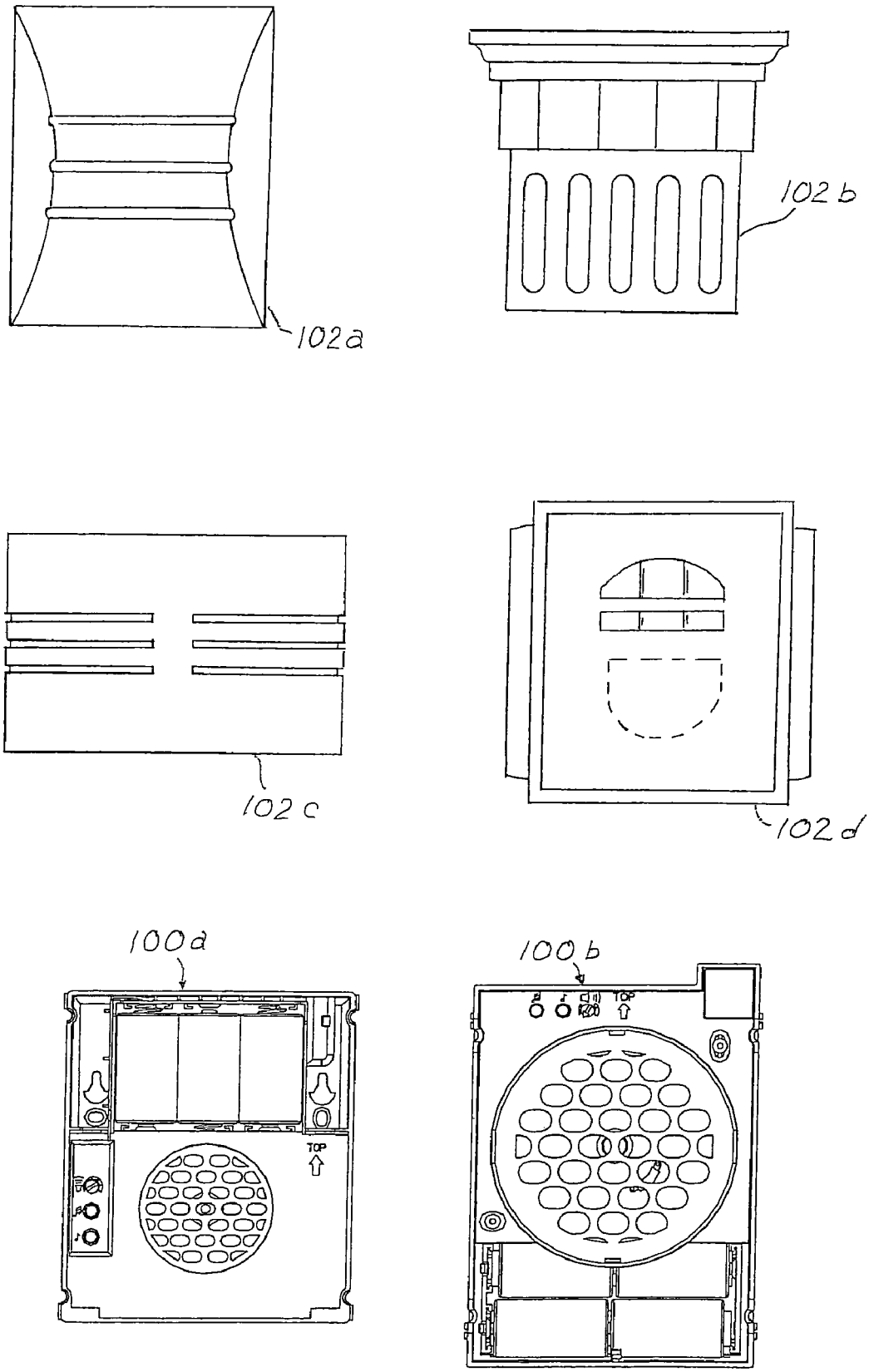
FIG. 4 shows components of a doorbell chime system having interchangeable chime bases and decorative covers.
Figure 6B:
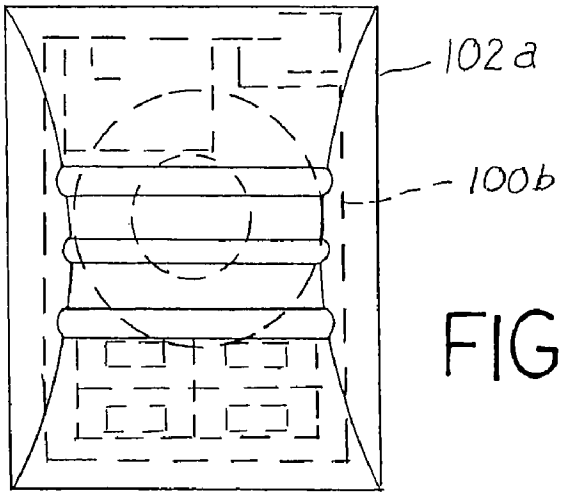
FIG. 6B shows the decorative cover and chime base installed in a vertical orientation.
Figure 6A:
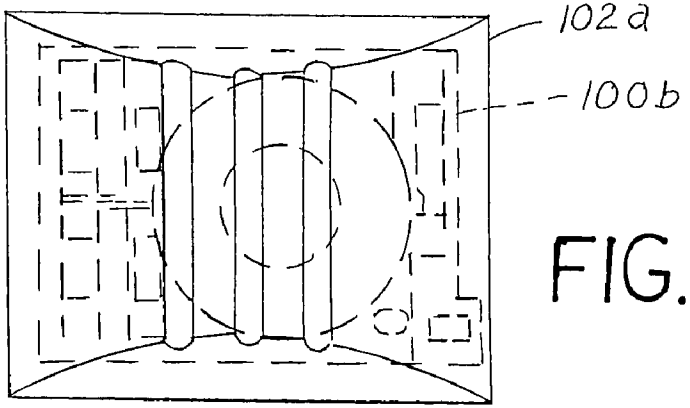
FIG. 6A depicts a second chime base with a decorative cover installed in a horizontal orientation.
Figure 5B:
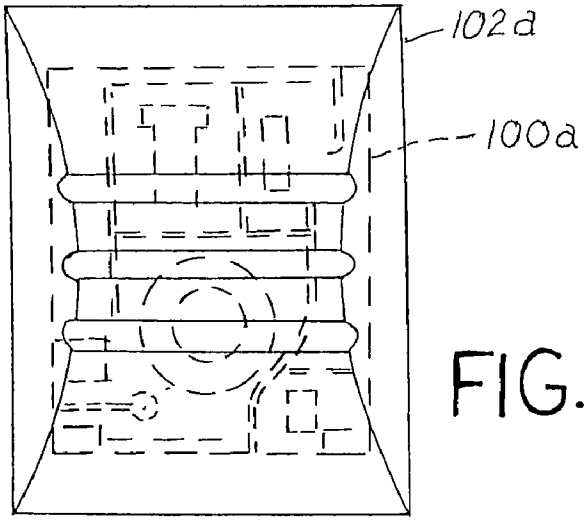
FIG. 5A depicts a first chime base with a decorative cover installed in a horizontal orientation and FIG. 5B shows the decorative cover installed on the chime base in a vertical orientation, both with the chime base shown in dashed lines for illustrative purposes.
Figure 5A:
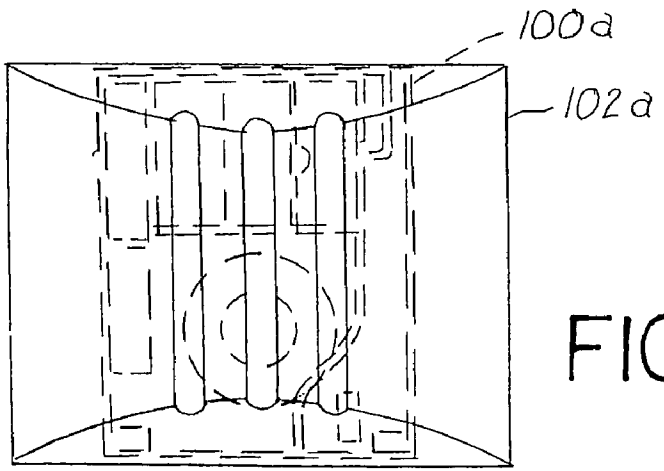

Turning now to FIGS. 2 and 3, a point-of-purchase sales display 32 for use in a retail setting includes a product display board 34 and preferably an adjacent parts bin 36. Display board 34 is shown set up over parts bin 36 in an area where a customer 38 can access the display and parts bin. Display board 34 is divided into five main regions 40*a-e*, each region for displaying a different subcomponent of the doorbell assembly. As depicted in FIG. 3, region 40*a* displays various styles of doorbell buttons 50, region 40*b* displays various wired chime bases 12*a* emitting different chime sounds, region 40*c* displays a variety of decorative covers 14*a-c*, region 40*d* displays a variety of wireless chime bases 12*b* having different chime sounds and, region 40*e* displays various accessories 52. Each region 40*a-e* includes appropriate signage designating what doorbell subcomponents are displayed in that particular region. For example, the region 40*c* displaying decorative covers would has signage that reads, "decorative covers". Each of the various chime bases 12*ab*, displayed on display board 34 is supplied with electrical power and connected to an actuator button 42. When an actuator button associated by color coding with a particular chime is pressed, the chime will sound. An identification code 44*a*, 44*b* is associated with each doorbell part displayed on display board 34.

Parts bin 36 includes a plurality of compartments 46 corresponding to the number of different parts available as indicated on the display board 34. Each compartment 46 is labeled with an identification code 44*a*, 44*b* that corresponds with one of the identification codes 44*a*, 44*b* on display board 34. Each compartment contains the same doorbell part displayed on display board 34 associated with that identifier. For example, a decorative cover 14*b* displayed on display board 34 is associated with identifier 44*a*. One of compartments 46 in parts bin 36 is labeled with the same identifier 44*a*, and a decorative cover 14*b* the same as decorative 14*b* on the display is contained in that compartment.

Display board 34 also includes a set of instructions 48 that are visible and readable by a customer 38 standing in front of the display 32. Instructions 48 detail three distinct steps to a customer on how to use the display. The customer is first directed to choose the type of doorbell activation mechanism desired, e.g. wired or wireless. Customer is then directed to select the chime base and associated chime sound desired, e.g. Big Ben, church bells, or a traditional ding-dong chime. The customer is then directed to choose the style of decorative cover desired. These instructions along with the hereinbefore described sales display 32 enable a customer standing in front of the sales display to simply and easily select a doorbell with a specific one of a plurality of chime sounds and a specific one of a plurality of decorative covers in a manner described forthwith.

A method of presenting a doorbell with interchangeable chimes and decorative covers for sale to the retail public includes using sales display 32 in conjunction with a doorbell 10 in a publicly accessible retail setting. Initially, a retailer sets up sales display 32 in the store in an area where a customer 38 can easily read display board 34, activate chime activator buttons 42, and access compartments 46 in parts bin 36. For example, a retailer might set up the sales display 32 in an open aisle area accessible to the public in a store. The retailer then stocks each of the compartments 46 with the appropriate doorbell parts corresponding to the doorbell parts shown on the display as herein before described. A customer 38 interested in buying a doorbell is allowed to approach the display 32 where the customer reads the easy to read instructions 48. Customer 38 then follows the instructions by first selecting whether a wire or wireless chime base is desired. Customer next selects the chime base desired by activating the various chimes with their associated actuators and selecting a preferred chime sound. Customer 32 then reads the identifier on display board 34 associated with the selected chime, identifies the appropriate compartment 46 with the same identifier, and then removes one of the corresponding parts contained within the compartment. Next the customer chooses a desired decorative cover from the several decorative covers displayed on display board 34, reads the identifier associated with the decorative cover selected, identifies the bin 46 with the same identifier, and picks a decorative cover from the bin. Customer 38 then preferably pays for the doorbell thus chosen and assembles the chime base and decorative cover to construct a doorbell that is tailored to the customer's individual aesthetic preferences.

Doorbell accessories 50 displayed on display board 34 may also be chosen at the same time as the doorbell in a similar manner as herein before described.

A preferred embodiment of a set of doorbell subcomponents having interchangeable chime bases and decorative covers is illustrated in FIGS. 4-15. One of chime bases 100*a*, 100*b* shown in FIG. 4 may be interchangeably combined with one of decorative covers 102*abcd*. Base 100*a* has an outline that allows cover 102*a* to be mounted to the vertically oriented base with the cover oriented either horizontally, as shown in FIG. 5A, or vertically, as shown in FIG. 5B, and still completely cover the base. Base 100*b* has an outline which requires cover 102*a* to be mounted to the base in the same vertical or horizontal orientation as the base, as shown in FIGS. 6A and 6B in order to completely cover the base. Whether the orientation of any particular cover can be rotated with respect to any particular base orientation and still completely cover that base depends on the outlines of both the base and the cover. Each base and cover, however, includes a set of attachment parts described more fully below to allow each of the covers to be interchangeably mounted to each of the bases at one of four 90° orientations.

Each chime base 100*a,b* includes a set of apparatus for producing an audible signal, which is not part of this invention, contained within a housing 104*a,b*. Each housing 104*a,b* is adapted for mounting to a support structure such as a wall (not shown) and connection to a signal actuator (not shown)

for allowing the chime base to produce its audible signal when a doorbell button (not shown) is pushed, all in any well known manner in the art.

Figure 7B:
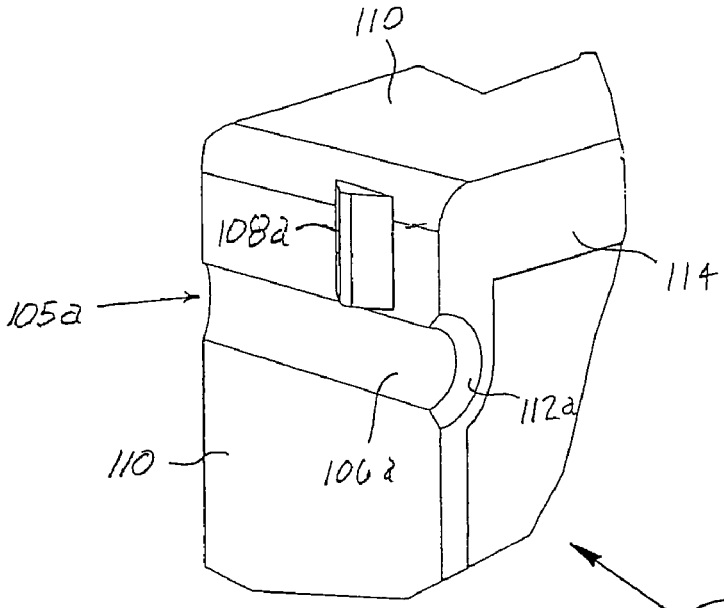
FIG. 7B is a detailed view of the attachment parts encircled in FIG. 7A.
Figure 7A:
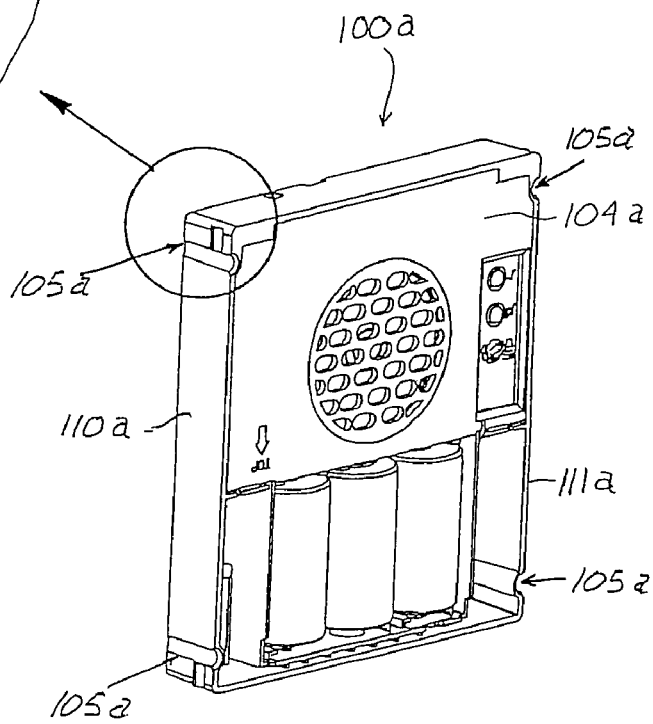
FIG. 7A is a front perspective view of the first chime base without a decorative cover.

Housing 104*a* of chime base 100*a*, best shown in FIGS. 7A and 7B, has four sets of attachment parts 105*a* each of which includes guide port 106*a* and an elongated tab 108*a* and a tapered or conical receptor 112. Because housing 104*a* is generally square shaped, a set of attachment parts 105*a* is located near each corner of housing 104*a*. Guide port 106*a* is a semicircular channel indented into the sidewall 110, 111 of housing 104*a* extending from the front side of the housing. Conical receptor 112 is located along the front edge of guide port 106*a* in the front wall 114 of housing 104*a*. Tab 108*a* is located adjacent guide port 106*a* and projects outwardly from sidewall 110, 111. A pair of attachment parts 105*a* are located on each sidewall 110*a*, 111*a* and are aligned vertically and horizontally so as to be located at the corners of a square.

Figure 8B:
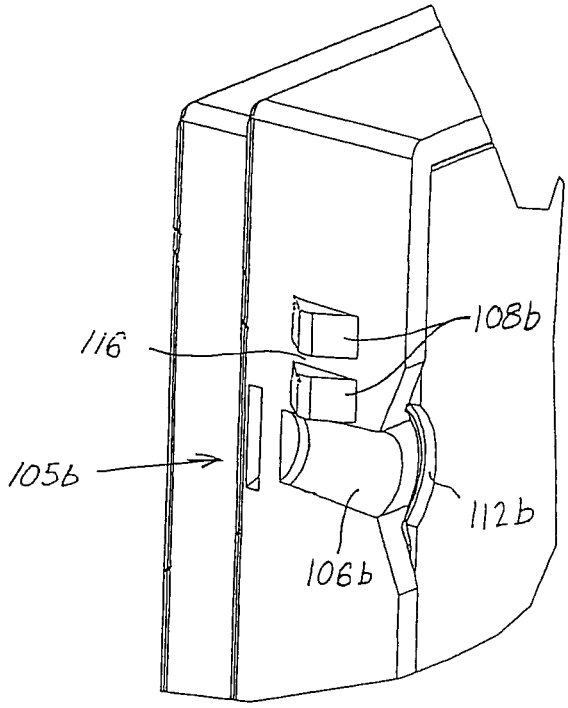
FIG. 8B is a detailed view of the attachment parts encircled in FIG. 8A.
Figure 8A:
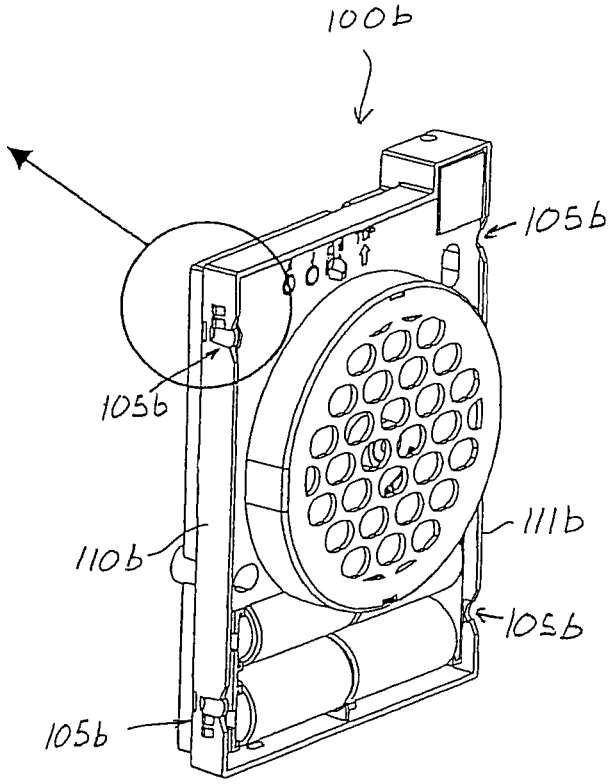
FIG. 8A is a front perspective view of the second chime base without a decorative cover.

Housing 104*b* of chime base 100*b*, best shown in FIGS. 8A and 8B, has four sets of attachment parts 105*b* each of which includes a guide port 106*b*, a conical receptor 112*b*, and a pair of aligned tabs 108*b*. A pair of attachment parts 105*b* are located on each sidewall 110*b*, 111*b* and aligned so as to be located at the corners of a square. Because housing 104*b* is generally an elongated rectangular shape, attachment parts 105*b* are not located near all the corners of the housing. Guide port 106*b* and receptor 112*b* are similar to port 106*a* and receptor 112*a*, respectively. Each pair of aligned tabs 108*b* are spaced apart from each other to form a gap 116 therebetween.

Figure 9A:
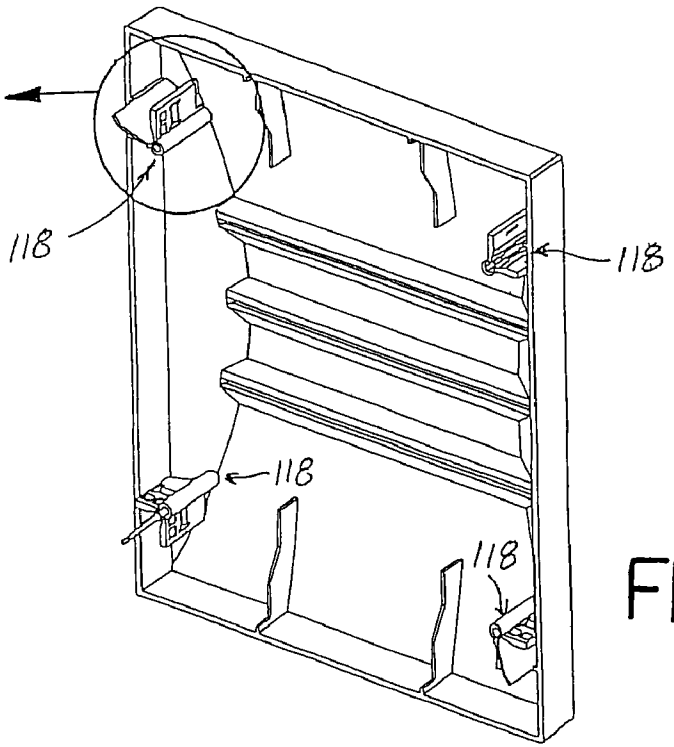
FIG. 9A is a rear perspective view of a decorative cover.
Figure 9B:
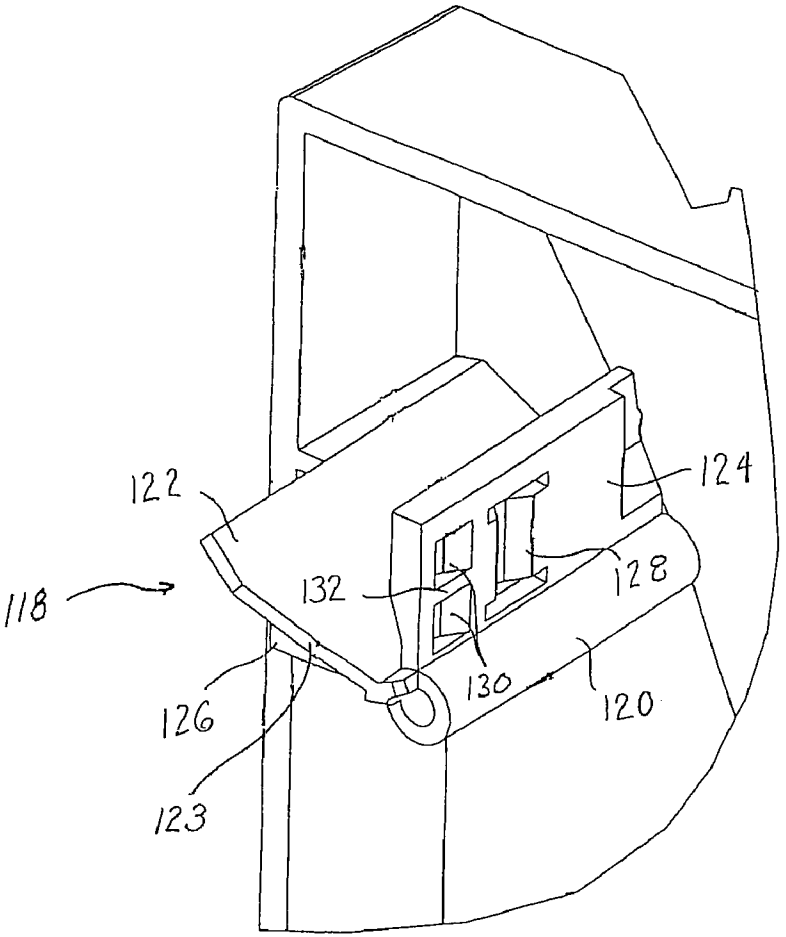
FIG. 9B is a detailed view of the attachments parts encircled in FIG. 9A.
Figure 10:
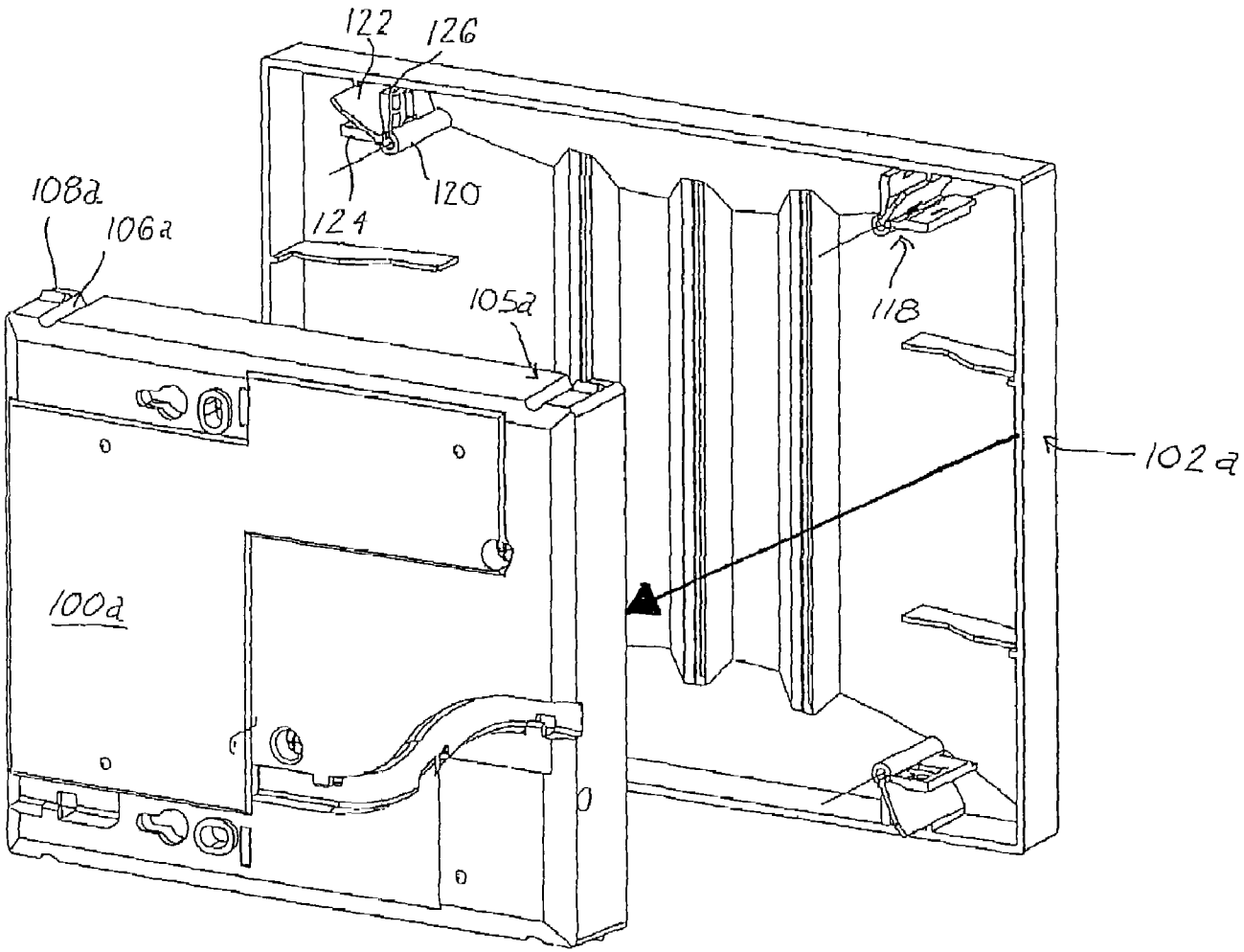
FIG. 10 is a rear perspective view of the chime base of FIG. 8A and a decorative cover with the decorative cover dismounted from the chime base.
Figure 11A:
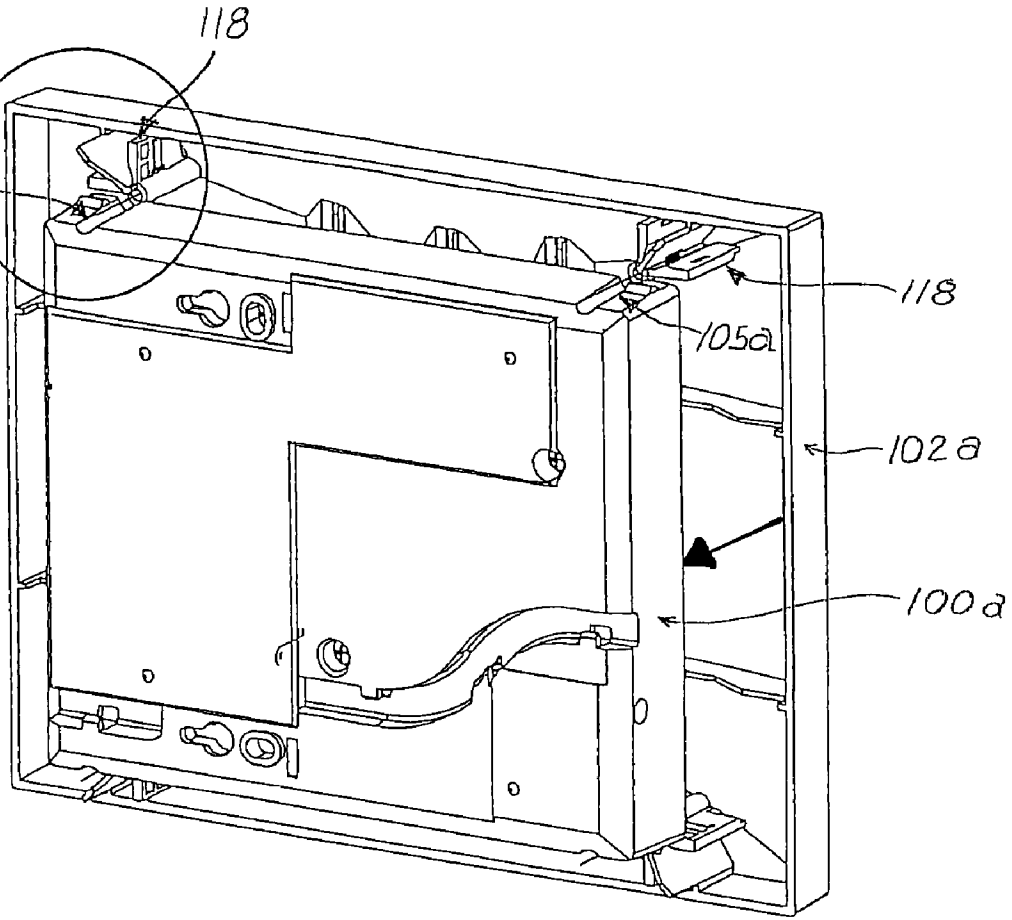
FIG. 11A is a rear perspective view of the chime base and decorative cover of FIG. 10 aligned for mounting.
Figure 11B:
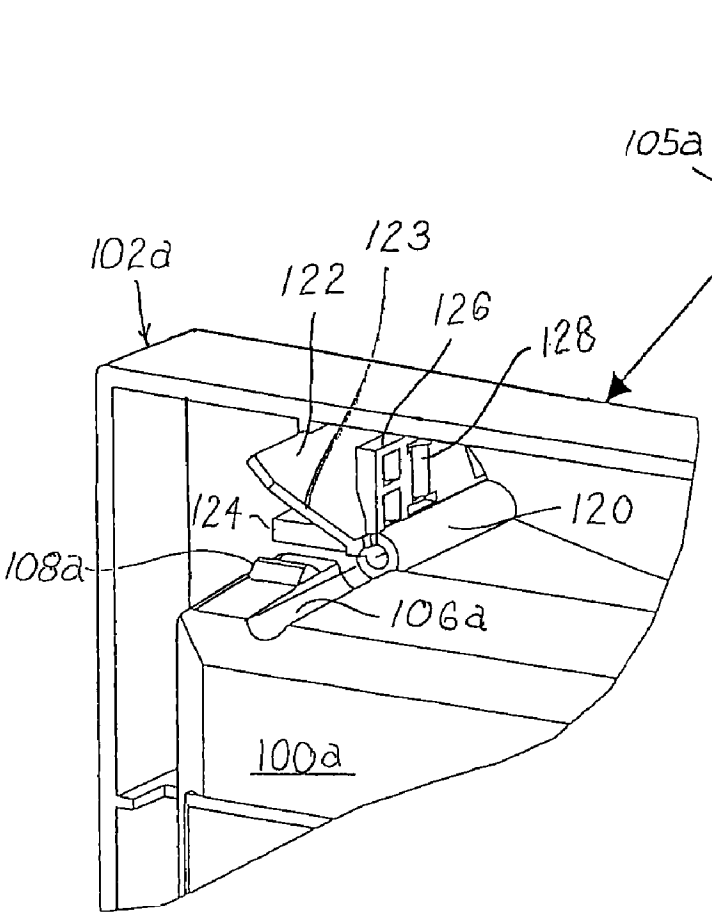
FIG. 11B is a detailed view of the aligned attachment parts encircled in FIG. 11A.
Figure 12:
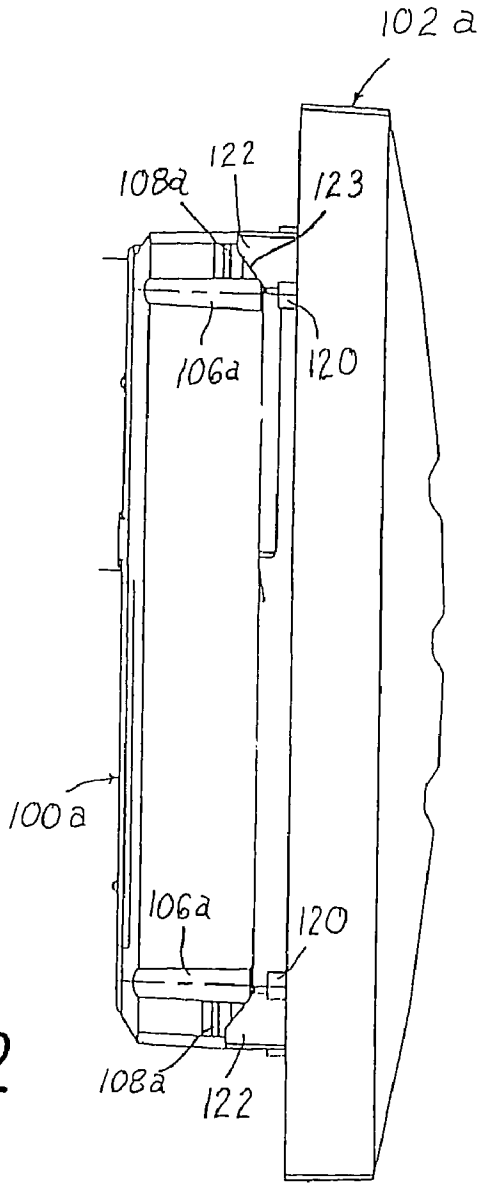
FIG. 12 is a side view of the aligned chime base and decorative cover of FIG. 11A.
Figure 14:
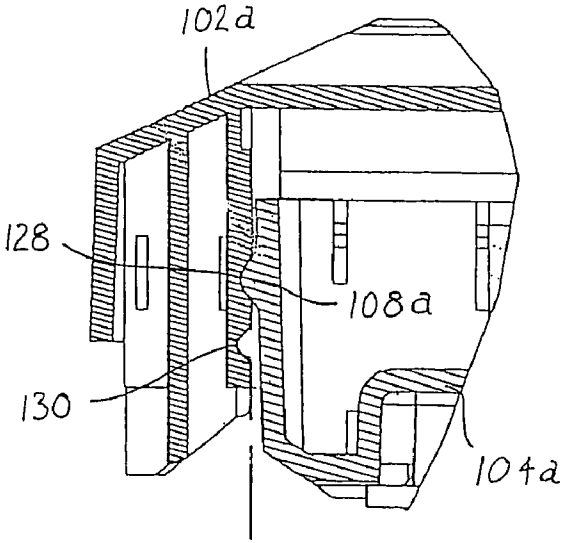
FIG. 14 is a detailed cross sectional view of the mated mounting parts of the chime base of FIG. 8A and a decorative cover.
Figure 15:
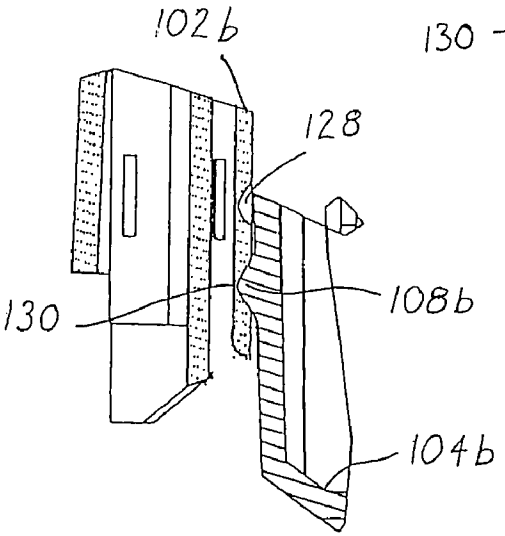
FIG. 15 is a detailed cross sectional view of the mated mounting parts of the chime base of FIG. 7A and a decorative cover.
Figures 13A, 13B:
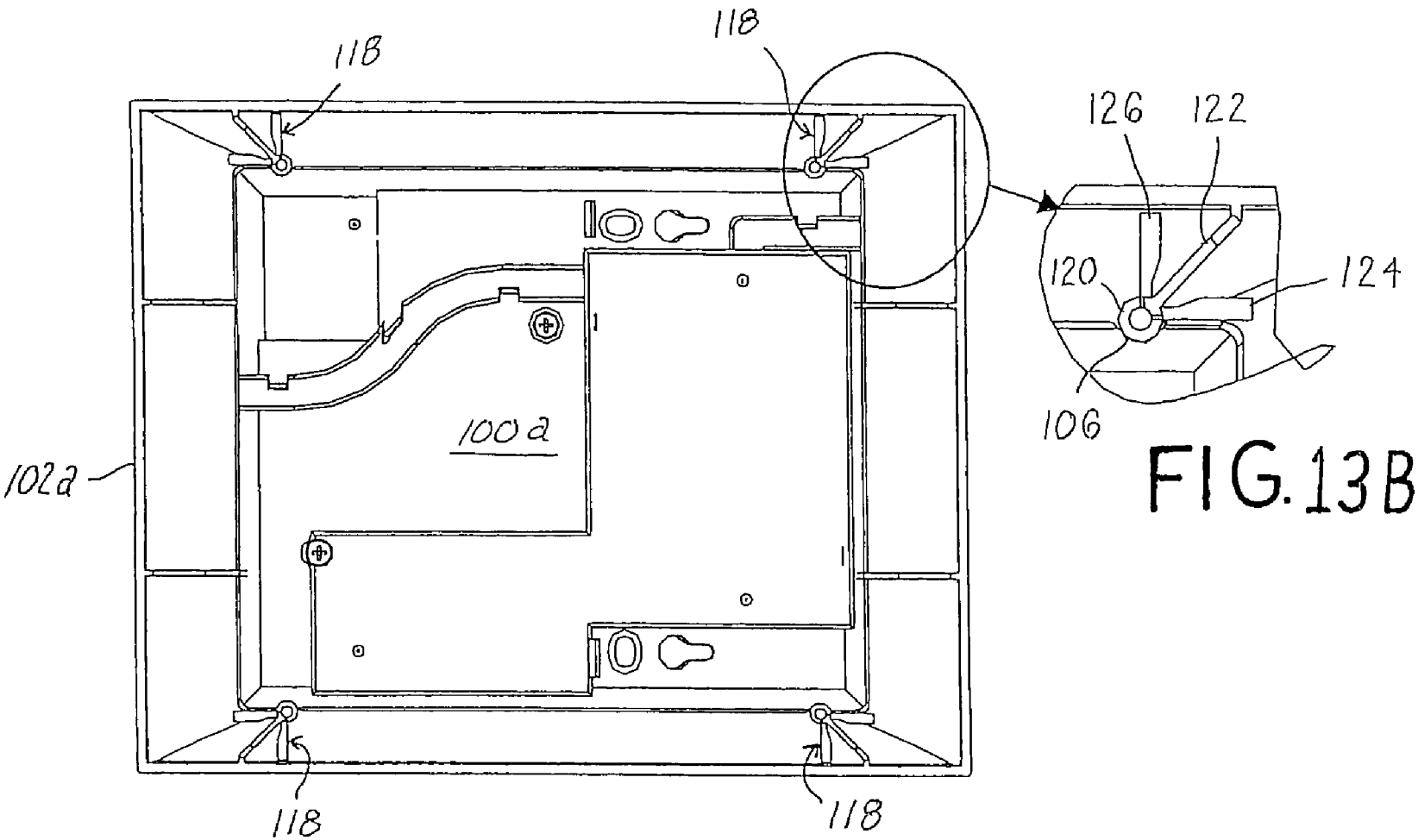
FIG. 13A is a rear view of the chime base and decorative cover of FIG. 11A with the decorative cover in its mounted position on the chime base.
FIG. 13B is a detailed view of the mated mounting parts encircled in FIG. 13A.

Each cover 102*a-d* includes a set of attachment parts 118, best shown in FIGS. 9A and 9B, that are used to connect the cover to either of bases 100*a,b*. Attachment parts 118 are located at the corners of a square so as to be alignable with attachment parts 105*a,b* on bases 100*a,b* in any of four 90° orientations. Each set of attachment parts 118 includes a guide post 120 and an alignment wall 122 protruding from the rear of the cover. Guide post 120 is a circular shaft for insertion into guide port 106*a,b* of bases 100*a,b*. Each alignment wall 122 extends away from guide post 120 at a 45° angle and is ramped inwardly or tapered toward the top of the guide post at leading edge 123 to help align the posts with the ports 106*a,b* as the cover is positioned over the base. Tab receptor walls 124, 126 extend away from each guide post 120 at a 90° orientation from each other on either side of alignment wall 122.

Each wall 124, 126 includes a first set of tab receptors 130 for accepting tabs 108*b* and a second tab receptor 128 for accepting tab 108*a* when the covers are mounted to the bases. Receptors 128 are spaced apart to form a rib 132 therebetween. Receptors 130 are located in front of receptors 128 so that elongated tab 108*a* will pass along rib 132 over receptors 130 and latch into receptor 128. Walls 124, 126 are oriented at 90° angles so that attachment parts 118 of the covers 102*a-d* will mate to attachment parts 105*a,b* in any of the four possible 90° orientations. In this way, tabs 108*a,b* will engage the appropriate tab receptors 128, 130 on either wall 124 or 126 depending on the orientation of the cover with respect to the base.

To mount a cover 102*a* to a base 100*a*, the cover is pressed onto the base as shown in FIGS. 10-15. Mounting parts 118 on the back of cover 102*a* are pointed and aligned roughly toward mounting parts 105*a* around base 100*a* and then urged toward the base. As cover 102*a* is urged toward base 100*a*, tapered alignment walls 122 catch against tapered receptors 112 to precisely align guide posts 120 with guide ports 106*a*, which accept the guide posts. Guide ports 106*a* align guide posts 120 so that tabs 108*a* are aligned with tab receptors 128, 130. As Cover 102*a* is urged fully into its mounted position on base 100*a*, tabs 108*a* slide over tab receptors 130 because of rib 132 and latch into tab receptors 128, as shown in detail in FIG. 14. Alternatively, if cover 102*a* is mounted to base 100*b* with tabs 108*b*, tabs 108*b* will latch into tab receptors 130 with rib 132 located between tabs 108*b* within gap 116 before reaching tab receptor 128, as shown in detail in FIG. 15. In this manner, the same cover 102*a* can accommodate both a thicker base 102*b* having tabs 108*b* received in tab receptors 130 and a thinner base 102*a* having tabs 108*a* received in tab receptors 128.

It will be readily appreciated that either tabs 108*a,b* or receptor walls 124, 126 are preferably of a resilient nature to allow either the tabs or the receptor walls to deflect as the tabs are urged across the receptor walls. When the tabs 108*a,b* encounter their respective receptors 128, 130, the tabs will snap into the receptor to lock the cover onto the base. The cover may later be removed from the base by urging or pulling it off of the base in the opposite direction.

The detailed description related herein is only meant to exemplify the preferred embodiment of the invention to enable those skilled in the art to make and use it. The subject invention is not to be limited to the details given above for the preferred embodiment, but may be modified within the scope of the impending claims.

We claim:

1. A chime unit for a doorbell system, said chime unit comprising:

a base for producing an audible signal when activated by said doorbell system, said base being adapted for mounting to a support structure;

a first cover for covering said base opposite said support structure;

first mounting parts carried by said base and second mounting parts carried by said cover, said cover having first mounted and second mounted positions covering said base, said cover carried by said base in either said first mounted or second mounted position, said first mounting parts releasably snap-fitted to said second mounting parts when said cover is in its said first mounted position, one of said first and second mounting parts including a first guide part, the other of said first and second mounting parts having a guide opening, a pair of radially spaced resilient catch parts carried by said one of said first and second mounting parts, said other of said first and second mounting parts having a catch recess, one of said catch parts fitted within said catch recess and said first guide part fitted within said guide opening when said cover is in its said either mounted position.

2. The chime unit of claim 1, and a second cover having third mounting parts, said second cover having a third mounted position covering said base, said third mounting parts releasably snap-fitted to said first mounting parts when said second cover is in its said mounted position.

3. The chime unit or claim 2, and a second base, said second base having fourth mounting parts, said first cover having fifth mounting parts, said first cover having a fourth mounted position covering said second base, said first cover carried by said second base when in its said fourth mounted position, said fourth mounting parts releasably snap fitted to said fifth mounting parts when said cover is in its said mounted position.

4. The chime unit of claim 1, and a second guide part adjacent said first guide part, said second guide part for guiding said first guide part toward said guide opening as said cover is shifted toward its said either mounted position.

* * * * *